US012583027B2

(12) United States Patent
Nakoshi

(10) Patent No.: US 12,583,027 B2
(45) Date of Patent: Mar. 24, 2026

(54) PLATE-LIKE MATERIAL FEEDING DEVICE

(71) Applicant: AIDA ENGINEERING, LTD., Kanagawa (JP)

(72) Inventor: Seiji Nakoshi, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 263 days.

(21) Appl. No.: 18/371,333

(22) Filed: Sep. 21, 2023

(65) Prior Publication Data

US 2024/0100584 A1 Mar. 28, 2024

(30) Foreign Application Priority Data

Sep. 28, 2022 (JP) ..... 2022-154651

(51) Int. Cl.
*B21D 43/09* (2006.01)

(52) U.S. Cl.
CPC ..... *B21D 43/09* (2013.01)

(58) Field of Classification Search
CPC ..... B21D 43/09; B21D 43/08
See application file for complete search history.

(56) References Cited

U.S. PATENT DOCUMENTS 11,173,537 B2 11/2021 Suzuki

FOREIGN PATENT DOCUMENTS

| | | | | |
|---|---|---|---|---|
| CN | 113714384 A * | 11/2021 | ..... | B21D 45/00 |
| EP | 3117920 A1 * | 1/2017 | ..... | B21D 43/09 |
| EP | 3974079 A1 | 3/2022 | | |
| JP | 2017-018992 A | 1/2017 | | |
| JP | 2018-047496 A | 3/2018 | | |
| WO | WO-2023120418 A1 * | 6/2023 | ..... | B65H 5/062 |

OTHER PUBLICATIONS

Translation of CN-113714384.*
Translation of WO-2023120418.*
Extended European Search Report received in EP Patent Application No. 23198554.0, dated Mar. 1, 2024.

* cited by examiner

*Primary Examiner* — Bobby Yeonjin Kim
(74) *Attorney, Agent, or Firm* — Rimon P.C.

(57) ABSTRACT

Provided is a plate-like material feeding device configured to sandwich a plate-like material between a lower roll rotatably supported on a device main body and an upper roll which is rotatable and arranged to face the lower roll in parallel thereto, so as to convey the plate-like material. The plate-like material feeding device includes: a lower gear integrally provided on a rotation shaft of the lower roll; an intermediate gear which is meshed with the lower gear, and is integrally provided on a rotation shaft of the upper roll; an upper gear meshed with the intermediate gear; a lower-roll drive motor which is coupled to the rotation shaft of the lower roll so as to drive the rotation shaft of the lower roll to rotate; and an upper-roll drive motor configured to drive the upper gear to rotate.

9 Claims, 8 Drawing Sheets

PLATE-LIKE MATERIAL FEEDING DEVICE

CROSS-REFERENCE TO RELATED APPLICATIONS

This application claims priority under 35 U.S.C. § 119 to Japanese Patent Application No. 2022-154651, filed on Sep. 28, 2022. The above application is hereby expressly incorporated by reference, in its entirety, into the present application.

BACKGROUND OF THE INVENTION

1. Field of the Invention

The present invention relates to a plate-like material feeding device that feeds a plate-like material to a downstream side (next process), for example, a plate-like material feeding device that conveys a plate-like material to be supplied to a press machine.

2. Description of the Related Art

Hitherto, as a technology for supplying a plate-like material (blank material in a sheet shape) to a press machine, for example, in Patent Literature 1, there is described, as illustrated in FIG. 7, a material feeding device that sandwiches a plate-like material M between an upper roll 1 and a lower roll 2, and drives the upper roll 1 to rotate by an upper-roll drive motor 1A through intermediation of a rotation shaft 1B and drives the lower roll 2 to rotate by a lower-roll drive motor 2A through intermediation of a rotation shaft 2B to convey the plate-like material.

Herein, Patent Literature 1 corresponds to Japanese Patent Application Laid-open No. 2017-18992, and Patent Literature 2 corresponds to Japanese Patent Application Laid-open No. 2018-47496.

In the material feeding device described in Patent Literature 1, the difference in inertia moment between the upper and lower rolls 1 and 2 is set to 0.001% or less to guarantee synchronousness of the upper roll 1 and the lower roll 2.

However, even when the difference in inertia moment between the upper and lower rolls 1 and 2 is set to 0.001% or less, and the upper and lower drive motors 1A and 2A are operated so as to be synchronized with each other in a controlled manner, the drive of the upper-roll drive motor 1A and the drive of the lower-roll drive motor 2A are separated, and hence it is assumed that a deviation in drive is caused between the motors for some reason. Thus, it is desired that the upper roll 1 and the lower roll 2 be mechanically coupled to each other to synchronize the upper roll 1 and the lower roll 2 with each other in view of an increase in conveyance speed, conveyance accuracy, safety, and the like.

Further, as illustrated in FIG. 8, in a material feeding device of Patent Literature 2, a lower-roll drive motor 7 that drives a lower roll shaft 5A to rotate is provided at one end of the lower roll shaft 5A coaxial with a lower roll 5, and an outer peripheral gear 5B that rotates integrally with the lower roll shaft 5A is provided at the other end of the lower roll shaft 5A. An outer peripheral gear 6B that is meshed with the outer peripheral gear 5B is substantially integrally mounted to an upper roll shaft 6A coaxial with an upper roll 6.

In Patent Literature 2 having such a configuration, the outer peripheral gear 5B and the outer peripheral gear 6B are meshed with each other. Thus, the lower roll 5 and the upper roll 6 are rotationally coupled to each other mechanically, and are mechanically synchronized with each other.

However, in the material feeding device having the configuration of Patent Literature 2, the lower roll 5 and the upper roll 6 are driven by a single motor, and hence there is a circumstance that the conveyance capacity is not so large as that in Patent Literature 1.

Thus, when the upper roll and the lower roll are mechanically synchronized with each other by the method of Patent Literature 2 and further the conveyance capacity is to be increased, it is conceivable to mount motors that drive the upper roll 6 (rotation shaft 6A) on right and left sides of the device (right-and-left direction in FIG. 8) as in Patent Literature 1. However, in such a case, the width of the device is increased so that the degree of freedom of installation of the device at a factory is decreased. Further, in addition to this problem, the drive motors are present on both the right and left sides so that the area in which wires for the drive motors are routed is increased. As a result, inconvenience is caused in a device maintenance operation, and maintainability of the device may be impaired.

Further, along with the increase in speed in the press machine in recent years, it is required to further increase a conveyance accuracy and a conveyance capacity also in the feeding device for a plate-like material while maintaining the small width of the device.

SUMMARY OF THE INVENTION

According to at least one embodiment of the present invention, there is provided a plate-like material feeding device configured to sandwich a plate-like material between a lower roll rotatably supported on a device main body and an upper roll which is rotatable and arranged in parallel to the lower roll, so as to convey the plate-like material. The plate-like material feeding device includes: a lower gear integrally provided on a rotation shaft of the lower roll; an intermediate gear which is meshed with the lower gear, and is integrally provided on a rotation shaft of the upper roll; an upper gear meshed with the intermediate gear; a lower-roll drive motor which is coupled to the rotation shaft of the lower roll so as to drive the rotation shaft of the lower roll to rotate; and an upper-roll drive motor configured to drive the upper gear to rotate.

In at least one embodiment of the present invention, the lower-roll drive motor and the upper-roll drive motor may be arranged on the same side with respect to the lower roll and the upper roll.

In at least one embodiment of the present invention, the lower-roll drive motor and the upper-roll drive motor may be located on a side opposite to a side on which the lower roll and the upper roll are arranged in relation to the intermediate gear.

In at least one embodiment of the present invention, the upper roll and the intermediate gear may be coupled to each other through intermediation of an Oldham's coupling.

In at least one embodiment of the present invention, a rotation center of the lower gear, a rotation center of the intermediate gear, and a rotation center of the upper gear may be arranged on the same straight line.

In at least one embodiment of the present invention, a straight line connecting a rotation center of the lower gear and a rotation center of the intermediate gear to each other and a straight line connecting the rotation center of the intermediate gear and a rotation center of the upper gear to each other may cross each other at a predetermined angle.

In at least one embodiment of the present invention, the plate-like material feeding device may further include an idle gear interposed between the intermediate gear and the upper gear.

In at least one embodiment of the present invention, the lower gear, the intermediate gear, and the upper gear may have the same module and the same number of teeth.

In at least one embodiment of the present invention, the lower gear and the intermediate gear may have the same module and the same number of teeth, and the upper gear may have the same module as the module of the lower gear and the intermediate gear and have the number of teeth larger than the number of teeth of the lower gear and the intermediate gear.

DETAILED DESCRIPTION OF THE PREFERRED EMBODIMENTS

Now, a plate-like material (sheet-like material or workpiece) feeding device (conveying device) according to embodiments of the present invention is described with reference to the attached drawings. The present invention is not limited by examples described below.

The present invention has been made in view of the above-mentioned circumstances, and has an object to provide a plate-like material feeding device which can be reduced in an installation space to improve the degree of freedom of installation layout and maintainability and has a high conveyance capacity while having a configuration which is relatively simple and compact and leads to low cost.

First Embodiment

Figure 1:
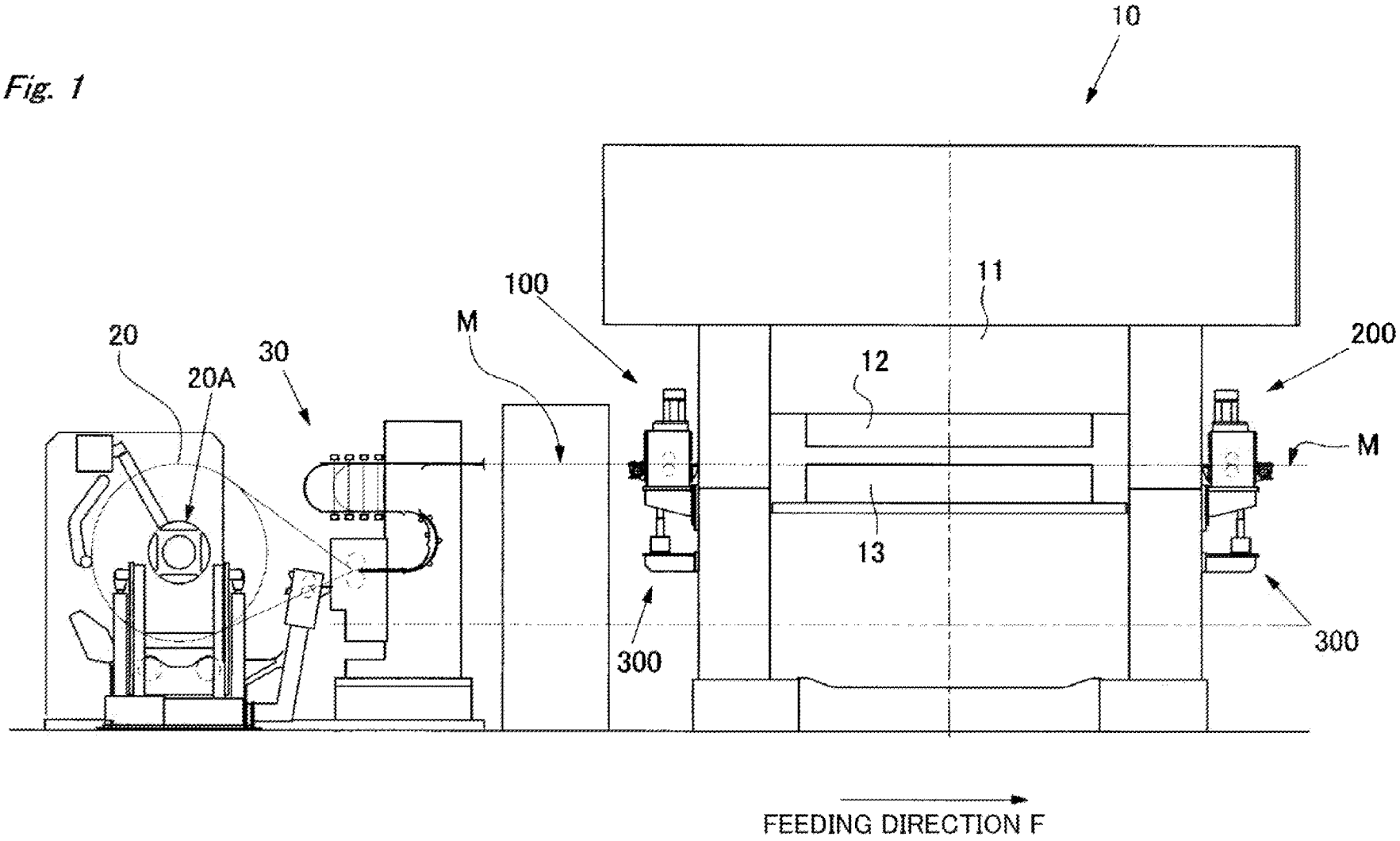
FIG. 1 is a front view for illustrating an example of a press machine including a plate-like material feeding device according to a first embodiment of the present invention.

FIG. 1 is an illustration of an example of a press machine 10 including plate-like material feeding devices 100 and 200 according to a first embodiment of the present invention. FIG. 1 is a front view, FIG. 2 is a plan view, and FIG. 3 is a left side view of FIG. 1.

The plate-like material feeding device 100 according to this embodiment is arranged on an upstream side in a feeding direction F of a plate-like material in the press machine 10. As illustrated in FIG. 1 to FIG. 3, an elongated plate-like material M wound around a roll 20, which is rotatably supported on a support shaft 20A, passes through a buffer mechanism 30. Then, the plate-like material M is supplied to the plate-like material feeding device 100. The buffer mechanism 30 is a device for length (position) adjustment, which is provided so that the position of the plate-like material M in the feeding direction is synchronized with the timing of press working of the press machine 10.

Figure 2:
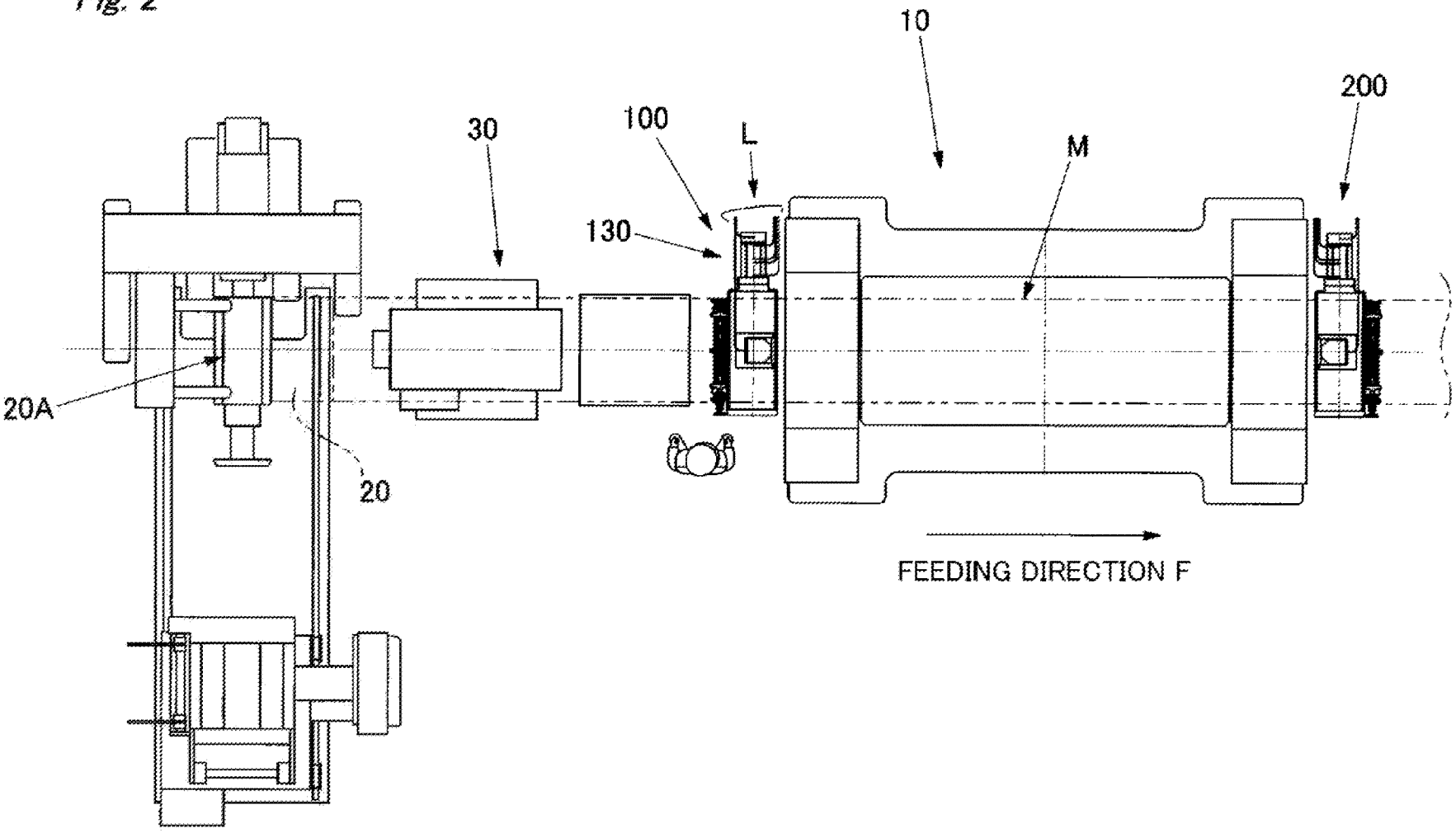
FIG. 2 is a plan view of FIG. 1.
Figure 3:
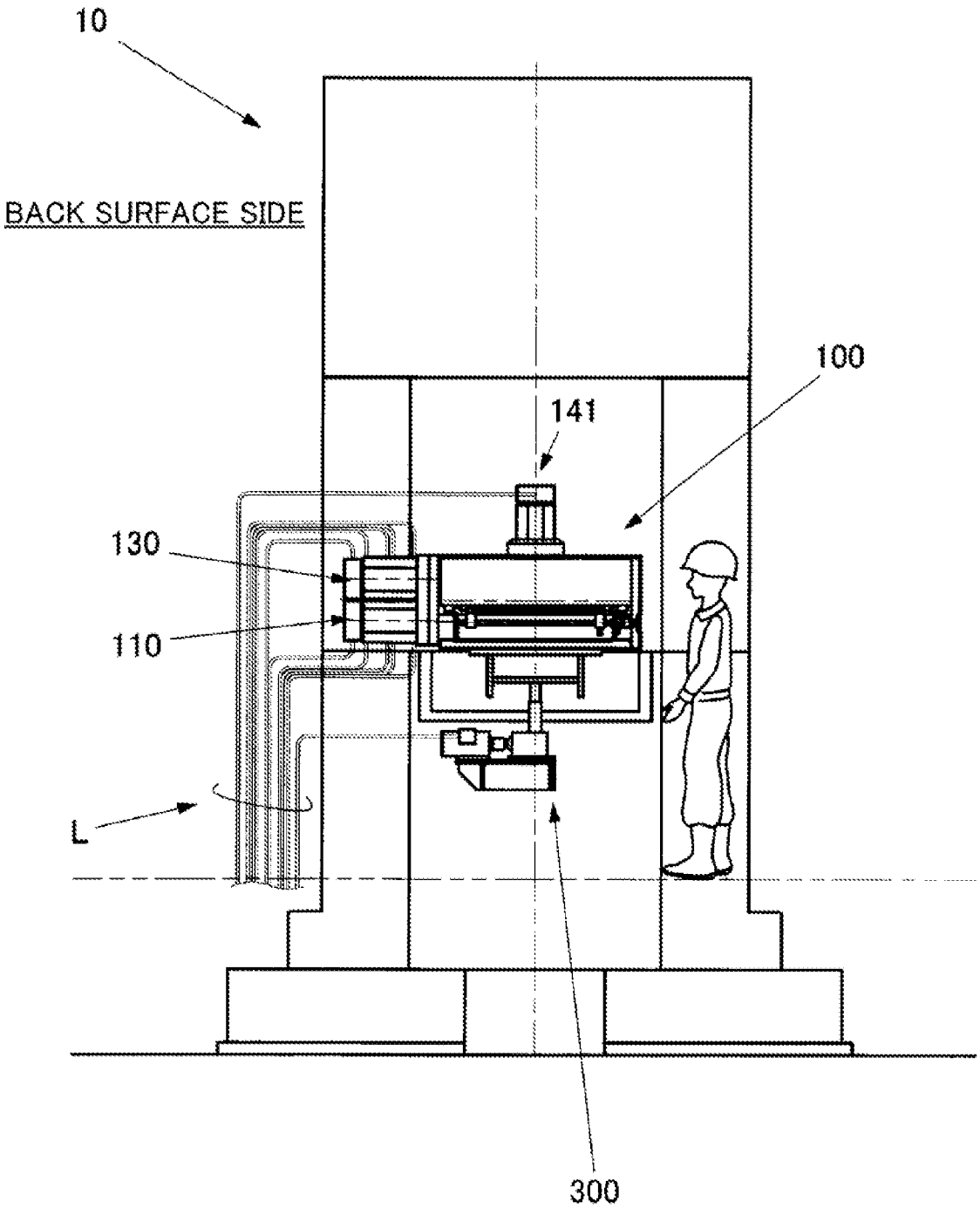
FIG. 3 is a left side view of FIG. 1.

Further, as illustrated in FIG. 1 and FIG. 2, the elongated plate-like material M supplied to the plate-like material feeding device 100 passes through a slide 11, an upper die 12, and a lower die 13 in the press machine 10 to be supplied to the plate-like material feeding device 200.

Then, in synchronization with the working timing of the press machine 10, the plate-like material feeding device 100 and the plate-like material feeding device 200 pull out the elongated plate-like material M from the roll 20 in the feeding direction F and feed the elongated plate-like material M to a predetermined position so that the elongated plate-like material M is subjected to press working by the press machine 10 at that position. After that, the plate-like material feeding device 100 and the plate-like material feeding device 200 feed the plate-like material M in the feeding direction F, and accordingly, the press machine 10 prepares for next press working.

Configuration examples of the plate-like material feeding device 100 and the plate-like material feeding device 200 according to this embodiment are described below. The plate-like material feeding device 100 and the plate-like material feeding device 200 have the same configuration, and hence the plate-like material feeding device 100 is described here as a representative.

Figure 4B:
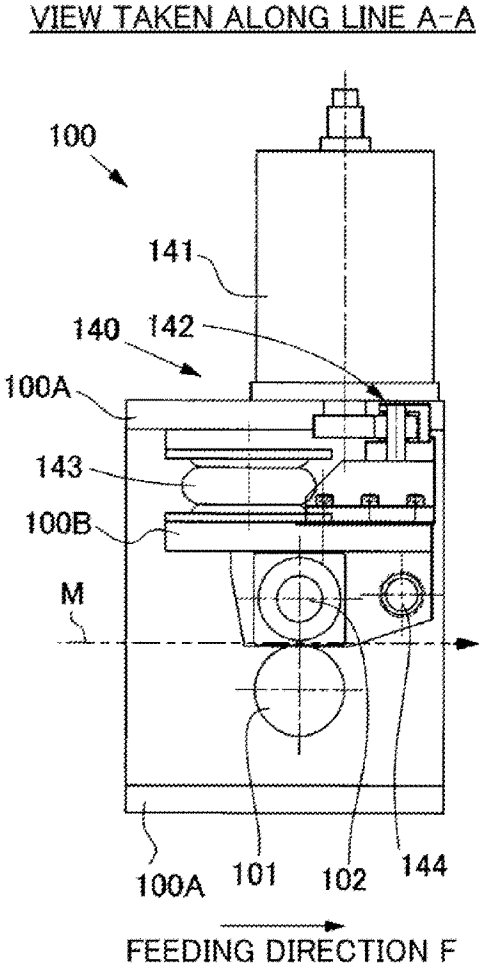
FIG. 4B is a view taken along the line A-A of FIG. 4A.
Figure 4A:
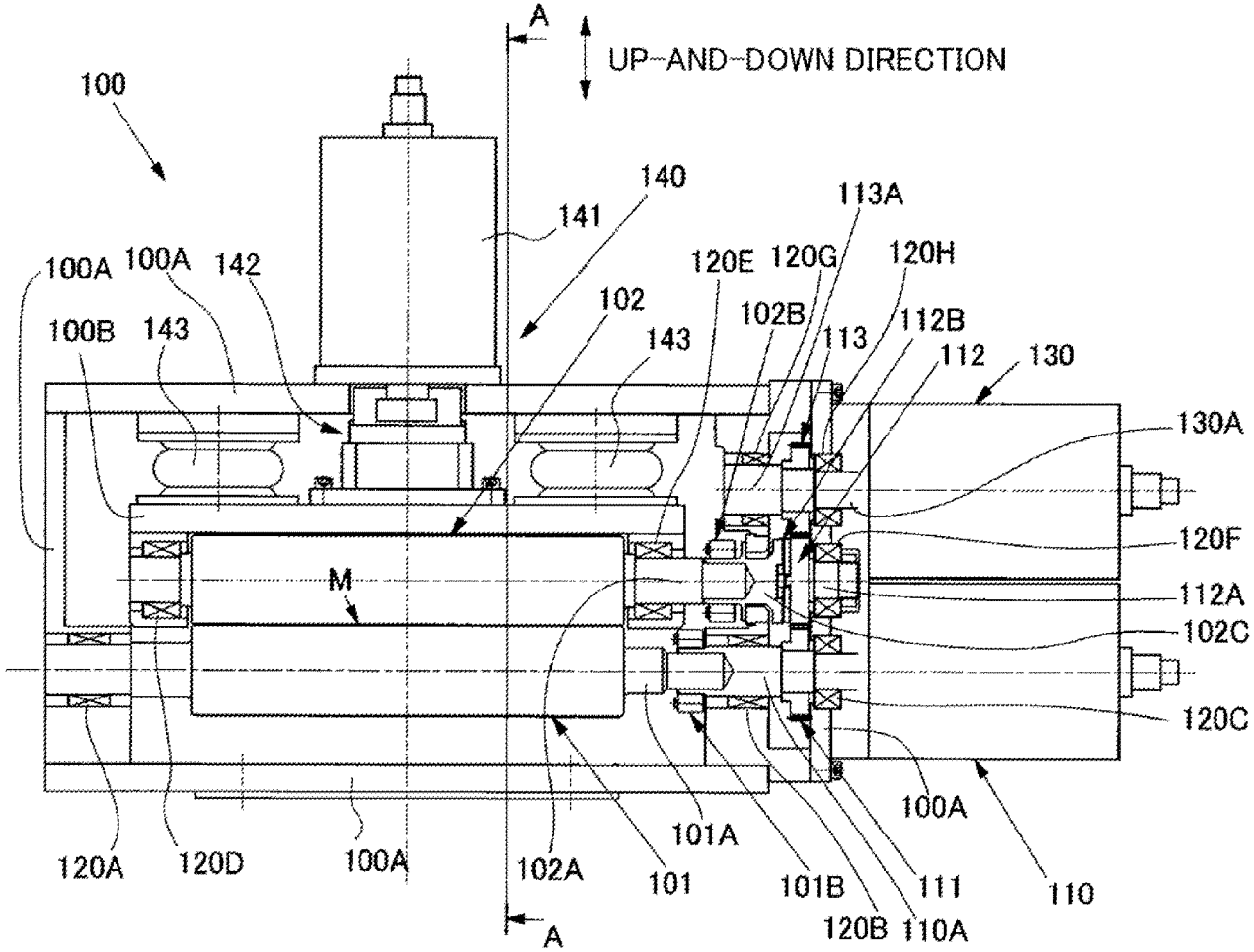
FIG. 4A is a sectional view of the plate-like material feeding device according to the first embodiment.

As illustrated in FIG. 4A and FIG. 4B, the plate-like material feeding device 100 includes a lower roll 101 and an upper roll 102 arranged in parallel to the lower roll 101 with a predetermined gap. The plate-like material M is supplied to the predetermined gap between the lower roll 101 and the upper roll 102.

A lower-roll rotation shaft 101A of the lower roll 101 has one end side rotationally coupled to an output shaft 110A of a lower-roll drive motor 110 by a lower friction fastener 101B or the like. This coupling may be achieved by spline coupling or the like.

A lower outer periphery gear (lower gear) 111 is provided to the output shaft 110A substantially integrally. An intermediate outer periphery gear (intermediate gear) 112 is meshed with the lower outer periphery gear 111 on an upper side of the lower outer periphery gear 111 (see FIG. 5A).

A rotation shaft 112A of the intermediate outer periphery gear 112 is rotationally coupled to an intermediate rotation element 102C through intermediation of an Oldham's coupling 112B. The intermediate rotation element 102C is rotationally coupled to an upper-roll rotation shaft 102A of the upper roll 102 through intermediation of an upper friction fastener 102B or the like. This coupling may also be achieved by spline coupling or the like.

The lower friction fastener 101B and the upper friction fastener 102B are mechanical elements that coaxially fasten two rotation shafts by fastening a bolt or the like by a wedge method using a wedge action, or mechanical elements that coaxially fasten two rotation shafts by a hydro method (hydraulic method) using the Pascal's principle.

The lower roll 101, the lower-roll rotation shaft 101A, the output shaft 110A, and the lower outer periphery gear 111 are rotationally supported on a device main-body frame 100A (casing or the like) through intermediation of bearings 120A, 120B, and 120C. The lower-roll drive motor 110 is mounted to the device main-body frame 100A substantially integrally.

The upper roll 102, the upper-roll rotation shaft 102A, and the intermediate rotation element 102C are rotationally supported on a frame 100B through intermediation of bearings 120D and 120E. Meanwhile, the rotation shaft 112A of the intermediate outer periphery gear 112 is rotationally supported on the device main-body frame 100A through intermediation of a bearing 120F.

The lower outer periphery gear 111 and the intermediate outer periphery gear 112 are gears having the same module and the same number of teeth. The frame 100B is configured to be movable relative to the device main-body frame 100A in an up-and-down direction in FIG. 4A and FIG. 4B through intermediation of a lifting and lowering mechanism 140.

Figure 5B:
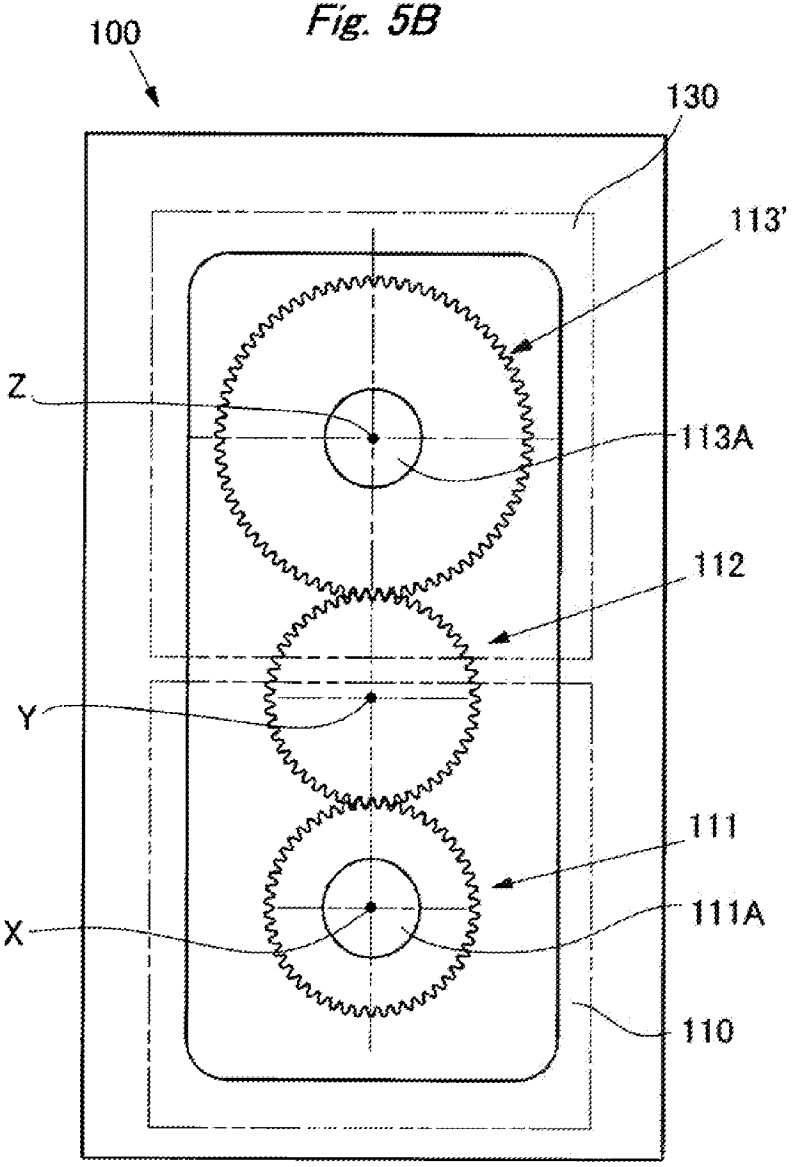
FIG. 5B is a side view for illustrating an example of employing an upper outer periphery gear having a large outer diameter in FIG. 5A.
Figure 5A:
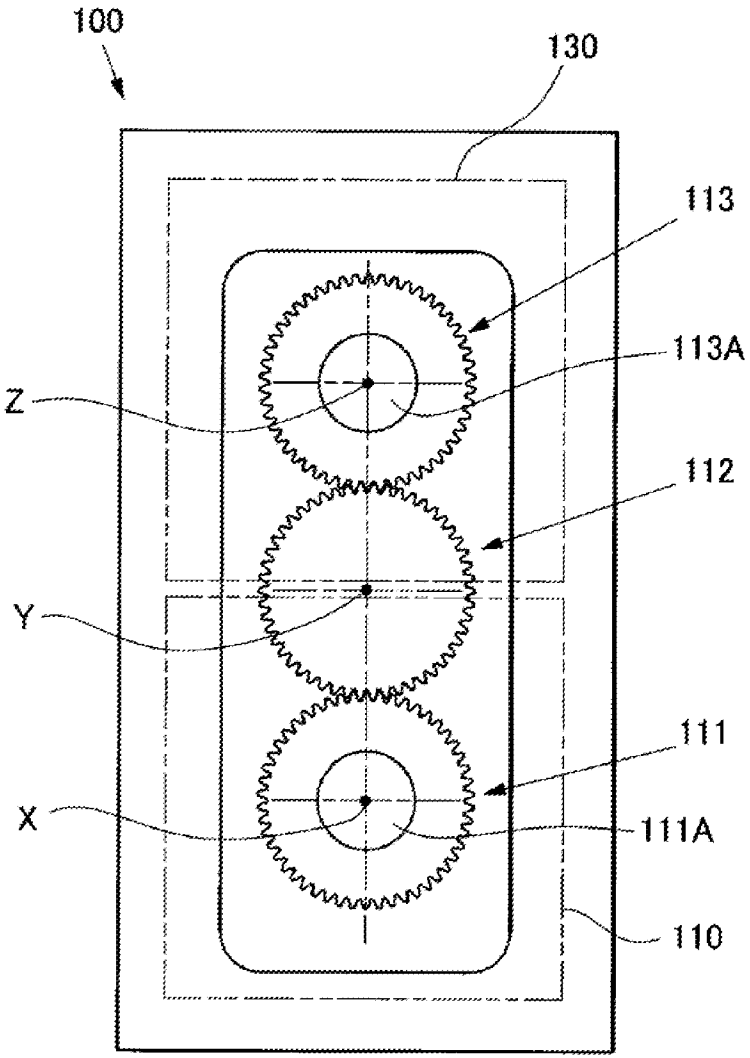
FIG. 5A is a side view for illustrating a gear portion of the plate-like material feeding device according to the first embodiment in an extracted manner.

In this embodiment, as illustrated in FIG. 4A and FIG. 5A, the intermediate outer periphery gear 112 is meshed with an upper outer periphery gear (upper gear) 113, and a rotation shaft 113A of the upper outer periphery gear 113 is formed integrally with an output shaft 130A of an upper-roll drive motor 130. The rotation shaft 113A of the upper outer periphery gear 113 is rotationally supported on the device main-body frame 100A through intermediation of bearings 120G and 120H. The upper-roll drive motor 130 is mounted to the device main-body frame 100A substantially integrally and on the same side as the lower-roll drive motor 110 with respect to the lower roll 101 and the upper roll 102.

In the plate-like material feeding device 100 having the configuration as described above, the plate-like material M pulled out from the roll 20 is supplied to the predetermined gap between the lower roll 101 and the upper roll 102. When the lower-roll drive motor 110 and the upper-roll drive motor 130 are driven to rotate in this state, the lower roll 101 and the upper roll 102 rotate. With this, the plate-like material M sandwiched between the lower roll 101 and the upper roll 102 is fed out in the predetermined feeding direction F (see FIG. 4B).

Here, in this embodiment, the lower roll 101 and the upper roll 102 are rotationally coupled to each other mechanically through intermediation of the lower outer periphery gear 111 and the intermediate outer periphery gear 112 so that the lower roll 101 and the upper roll 102 are mechanically synchronized with each other.

As illustrated in FIG. 4A and FIG. 4B, the lifting and lowering mechanism 140 includes a lift motor 141 supported on the device main-body frame 100A substantially integrally. The frame 100B is supported on an output shaft of the lift motor 141 through intermediation of a rotation and oscillation motion conversion mechanism 142 such as an eccentric cam. Further, the lifting and lowering mechanism 140 includes a gas spring device 143, and with the gas spring device 143, a predetermined pressing force is caused to act around an oscillation shaft 144. Thus, when the output shaft of the lift motor 141 is rotated in a predetermined direction, the frame 100B moves in a downward direction through intermediation of the rotation and oscillation motion conversion mechanism 142, and when the output shaft of the lift motor 141 is rotated in a reverse direction, the frame 100B moves in an upward direction through intermediation of the rotation and oscillation motion conversion mechanism 142.

At the time of conveyance of the plate-like material M, in the rotation and oscillation motion conversion mechanism 142, for example, the eccentric cam is adjusted to a position that forms a gap with a cam follower so that an action of the gas spring device 143 is generated toward the upper roll 102. As a result, the plate-like material M located between the lower roll 101 and the upper roll 102 is clamped.

After conveyance of the plate-like material M, at the time of press working, in the rotation and oscillation motion conversion mechanism 142, for example, the eccentric cam presses the cam follower so that a force against the acting force of the gas spring device 143 to the upper roll 102 is generated. As a result, the plate-like material M located between the lower roll 101 and the upper roll 102 is unclamped. With this, the plate-like material M can finely move at the time of press working.

As described above, the frame 100B is moved relative to the device main-body frame 100A in the up-and-down direction using the lifting and lowering mechanism 140 so that the position of the upper roll 102 in the up-and-down direction is adjusted. In this case, deviation (eccentricity) between the "upper-roll rotation shaft 102A of the upper roll 102 (intermediate rotation element 102C)" and the "rotation shaft 112A of the intermediate outer periphery gear 112", which is caused when the upper roll 102 is moved relative to the lower roll 101, may be absorbed by the Oldham's coupling 112B.

Further, in this embodiment, the rotation force of the upper-roll drive motor 130 may be transmitted not only to the upper roll 102 but also to the lower roll 101 through intermediation of the upper outer periphery gear 113 and the intermediate outer periphery gear 112. Similarly, the rotation force of the lower-roll drive motor 110 may be transmitted not only to the lower roll 101 through intermediation of the output shaft 110A and the lower-roll rotation shaft 101A but also to the upper roll 102 through intermediation of the lower outer periphery gear 111 and the intermediate outer periphery gear 112. Thus, by a drive force obtained by combining two drive sources of the upper-roll drive motor 130 and the lower-roll drive motor 110, each of the upper roll 102 and the lower roll 101 may rotate to feed the plate-like material M. That is, the conveying capacity of the plate-like material feeding device 100 may be improved.

Further, with the plate-like material feeding device 100 according to this embodiment, as illustrated in FIG. 2, FIG. 3, and FIG. 4A, the lower-roll drive motor 110 and the upper-roll drive motor 130 are arranged on the same side (one side) with respect to the lower roll 101 and the upper roll 102. Thus, as compared to a case in which an upper drive motor is mounted on one side of the plate-like material feeding device 100 and a lower drive motor is mounted on an opposite side, the width of the plate-like material feeding device 100 as a whole may be reduced. With this, the degree of freedom of installation of the feeding device at a factory may be improved, and wires and the like of the plate-like material feeding device 100 may be gathered on one side. As a result, access to the plate-like material feeding device 100 at the time of maintenance becomes easier, and maintainability, workability, and the like may be maintained high.

That is, according to this embodiment, it is possible to provide the plate-like material feeding device which is reduced in the installation space to improve the degree of freedom of the installation layout and the maintainability and has a high conveyance capacity while having a configuration which is relatively simple and compact and leads to low cost.

Further, the plate-like material feeding device 100 according to this embodiment has the following unique functions and effects.

As illustrated in FIG. 4A, the intermediate outer periphery gear 112 and the upper roll 102 are coupled to each other through intermediation of the Oldham's coupling 112B. Thus, even when the drive force of the lower-roll drive motor 110 is transmitted to the intermediate outer periphery gear 112, a reaction force generated due to the drive force is not directly generated in the upper roll 102. That is, although the rotation force of the lower-roll drive motor 110 is transmitted to the upper roll 102, upward warpage is not caused in the upper roll 102. That is, even when the drive force of the lower-roll drive motor 110 is increased, the parallel state of the lower roll 101 and the upper roll 102 is maintained. With this, the pushing force applied to the plate-like material M by the lower roll 101 and the upper roll 102 becomes uniform over the width direction of the plate-like material M. As a result, according to this embodiment, the plate-like material may be prevented from skewing to improve the conveyance accuracy of the plate-like material while improving the conveyance capacity of the plate-like material feeding device 100.

Further, with the plate-like material feeding device 100 according to this embodiment, the operation safety may be improved.

That is, as illustrated in FIG. 2, FIG. 3, and FIG. 4A, two drive sources of the lower-roll drive motor 110 and the upper-roll drive motor 130 are arranged on the same one end side. Thus, wires and the like for each drive motor are gathered, and the operation area at the periphery of the plate-like material feeding device 100 is secured easily. As a result, an adjustment operation performed when a material is jammed in the middle of production or the plate-like material M meanders or skews may be performed quickly and safely.

Further, when the upper-roll drive motor 130 cannot be used due to a trouble or the like or when power consumption is desired to be kept low without using the upper-roll drive motor 130 in consideration of the conveyance capacity, in the unique configuration of the plate-like material feeding device 100 according to this embodiment, the upper-roll drive motor 130 may be removed easily, and production is tentatively possible using only the lower-roll drive motor 110. As a result, this configuration may contribute to provision of a device which is capable of meeting a wide range of requirements of a user and is thus user-friendly.

Further, with the unique configuration of the plate-like material feeding device 100 according to this embodiment, the upper-roll drive motor 130 may be removed easily (or prevented from being driven). Thus, motor power may be optimized in accordance with material specifications such as a thickness, a material, surface finishing, or a width dimension or a feeding condition of a material. The capabilities of upper and lower motors are not required to be the same, and hence power of one motor may be changed as necessary.

That is, in this embodiment, the upper-roll drive motor 130 and the lower-roll drive motor 110 are coupled to each other through intermediation of the lower outer periphery gear 111, the intermediate outer periphery gear 112, and the upper outer periphery gear 113. With this configuration, the sum of the capabilities of the drive motors is equally distributed to the lower roll 101 and the upper roll 102. Thus, power of only a drive motor on one side may be changed as necessary. As a result, this configuration may contribute to provision of a device which is capable of meeting a wide range of requirements of a user and is thus user-friendly.

At this time, as in FIG. 5B, an upper outer periphery gear 113' having a large outer diameter may be employed when a peripheral velocity is adjusted. In this case, the module of the upper outer periphery gear 113' is the same as those of the lower outer periphery gear 111 and the intermediate outer periphery gear 112, whereas the number of teeth of the upper outer periphery gear 113' is larger than those of the lower outer periphery gear 111 and the intermediate outer periphery gear 112. In this case, the axis-to-axis distance between the lower outer periphery gear 111 and the upper outer periphery gear 113' (distance between X and Z) is increased as compared with the axis-to-axis distance (distance between X and Z) in the example of FIG. 5A. Thus, when the motor capacity is increased, physical interference between upper and lower drive motors may be avoided.

Incidentally, as illustrated in FIG. 3, on a lower side of the plate-like material feeding device 100, a screw jack 300 is provided so as to move the plate-like material feeding device 100 upward and downward relative to the press machine 10 at the time of replacing a die or a material.

Figure 7:
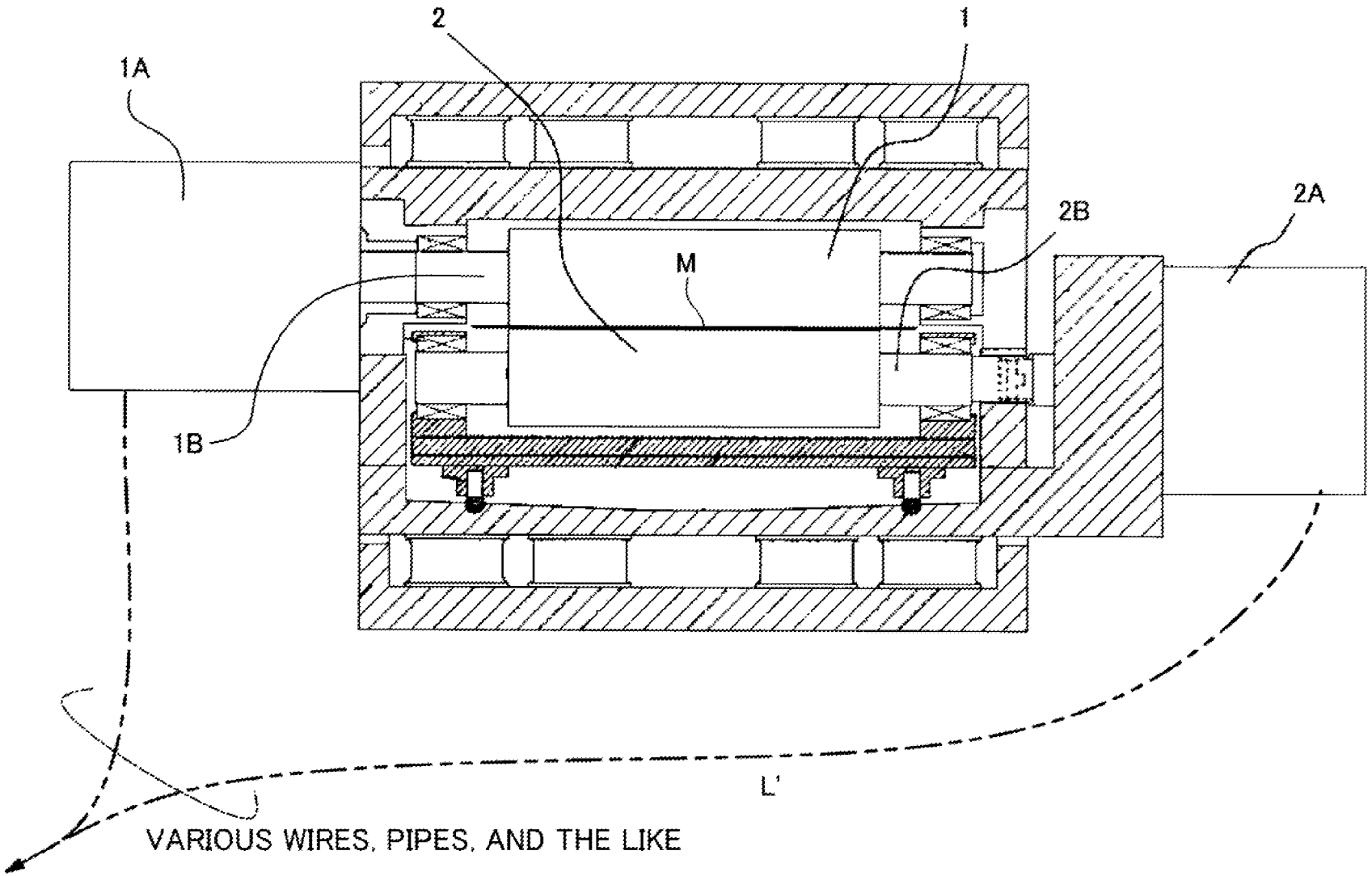
FIG. 7 is a sectional view for illustrating an example of a material feeding device of a related art (Patent Literature 1).
Figure 8:
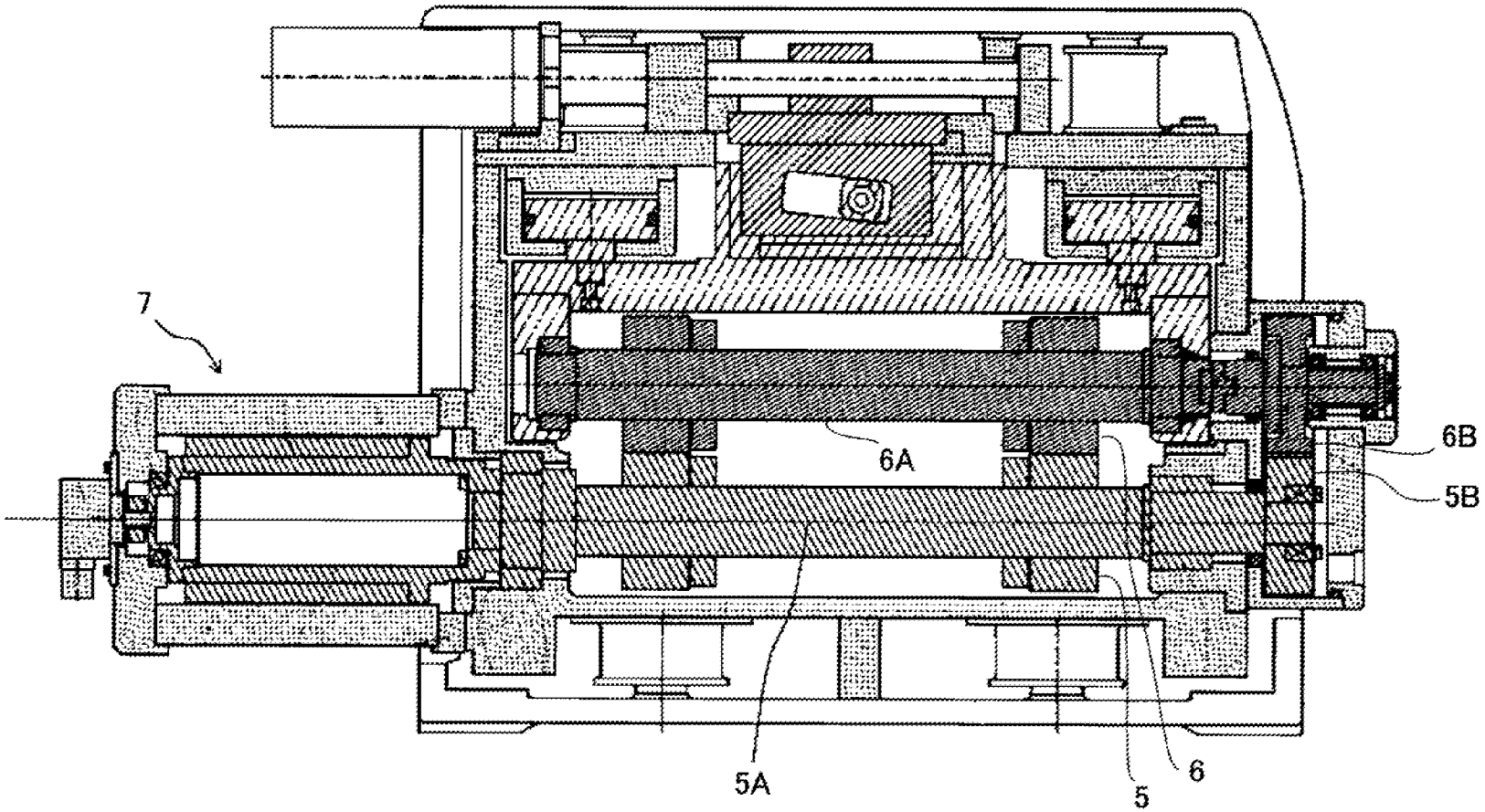
FIG. 8 is a sectional view for illustrating another example of a material feeding device of a related art (Patent Literature 2).

In such a case, when drive motors are arranged on both sides of upper and lower rolls as in Patent Literature 1 illustrated in FIG. 7, electric wires, cooling medium pipes, and the like (see reference symbol L' of FIG. 7) from one drive motor pass the vicinity of or below the screw jack 300. Thus, an operation of upward and downward movement of the plate-like material feeding device 100 becomes difficult.

In contrast, in this embodiment, as illustrated in FIG. 3, the lower-roll drive motor 110 and the upper-roll drive motor 130 are collectively arranged on the back surface (rear) side (left end side of FIG. 3) of the press machine 10. Thus, electric wires, cooling medium pipes, and the like (reference symbol L) may be gathered on the back surface side of the press machine 10 without being caused to pass the vicinity of or below the screw jack 300. As a result, an operation of upward and downward movement of the plate-like material feeding device 100 may be easily executed.

Second Embodiment

In the first embodiment, as illustrated in FIG. 5A or the like, the example of including three gears of the lower outer periphery gear 111, the intermediate outer periphery gear 112, and the upper outer periphery gear 113 is described. In contrast, in a second embodiment of the present invention, although the basic configuration is the same as that of the first embodiment, as illustrated in FIG. 6A, the lower outer periphery gear 111, the intermediate outer periphery gear 112, and the upper outer periphery gear 113 are provided, and further an idle gear 150 is provided between the intermediate outer periphery gear 112 and the upper outer periphery gear 113.

As described above, the idle gear 150 is interposed between the intermediate outer periphery gear 112 and the upper outer periphery gear 113. Thus, the rotating direction of the lower-roll drive motor 110 that drives the lower outer periphery gear 111 and the rotating direction of the upper-roll drive motor 130 that drives the upper outer periphery gear 113 are reversed.

Acceleration/deceleration torque generated due to a rotating operation of the lower-roll drive motor 110 causes a first reaction force to be generated in the device main-body frame 100A through intermediation of the output shaft 110A. Acceleration/deceleration torque generated due to the rotating operation of the upper-roll drive motor 130 at this time is torque in a direction reverse to that of the above-mentioned acceleration/deceleration torque of the lower-roll drive motor 110 and causes a second reaction force to be generated in the device main-body frame 100A through intermediation of the output shaft 130A. The first reaction force and the second reaction force have a relationship of being in reverse directions similarly to the relationship between the acceleration/deceleration torque of the lower-roll drive motor 110 and the acceleration/deceleration torque of the upper-roll drive motor 130. That is, the first and second reaction forces are generated such that one cancels out the other. As a result, vibration or noise in the device main-body frame 100A may be suppressed.

Figure 6B:
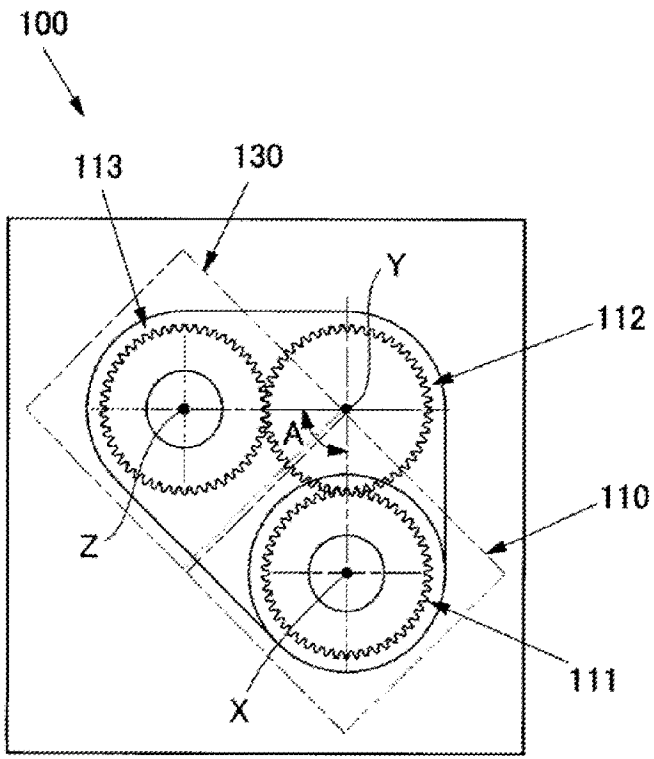
FIG. 6B is a side view for illustrating a gear portion of a plate-like material feeding device according to a third embodiment of the present invention in an extracted manner.
Figure 6A:
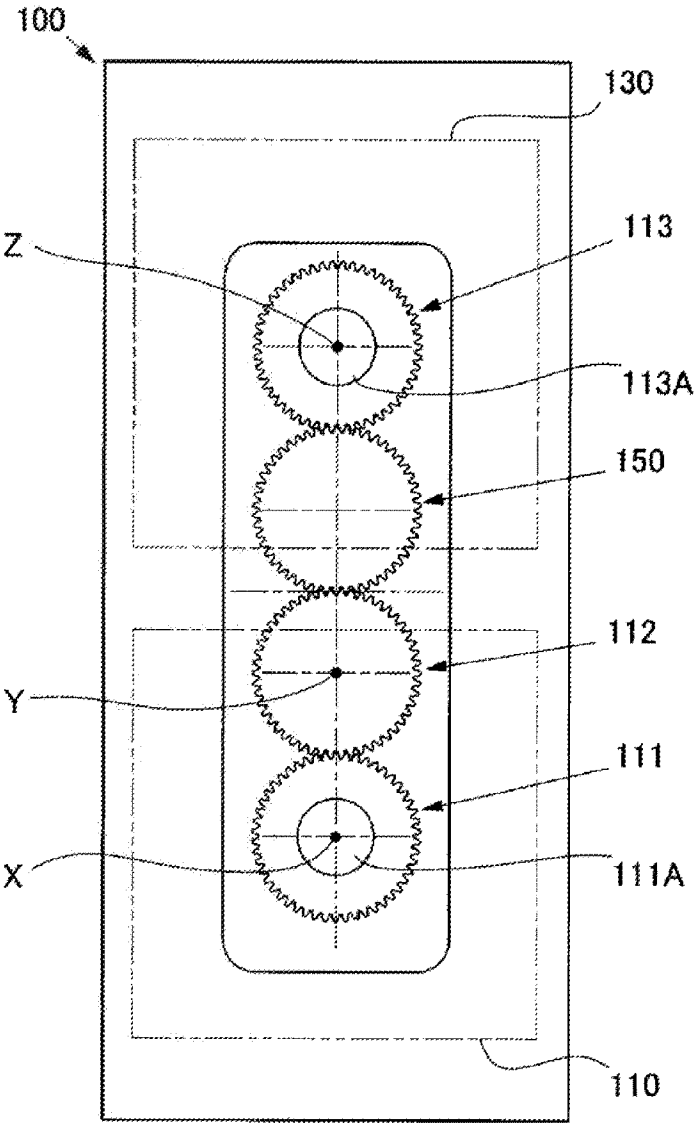
FIG. 6A is a side view for illustrating a gear portion of a plate-like material feeding device according to a second embodiment of the present invention in an extracted manner.

Further, in this embodiment, as illustrated in FIG. 6A, the axis-to-axis distance (distance between X and Z) between the lower outer periphery gear 111 and the upper outer periphery gear 113 is increased as compared with the axis-to-axis distance (distance between X and Z) in the example of FIG. 5A, thereby being capable of contributing to avoidance of interference of a case accompanied by an increase in the motor capacity.

Thus, according to this embodiment, similarly to the first embodiment, it is possible to provide the plate-like material feeding device which is reduced in the installation space to improve the degree of freedom of the installation layout and the maintainability and has a high conveyance capacity while having a configuration which is relatively simple and compact and leads to low cost. In addition, this configuration may further contribute to provision of a device which is capable of meeting a wide range of requirements of a user and is thus user-friendly.

Also in this embodiment, similarly to FIG. 5B according to the first embodiment, the upper outer periphery gear 113' having a large outer diameter may be employed.

Third Embodiment

In the first embodiment, as illustrated in FIG. 5A and other figures, rotation centers X, Y, and Z of the three gears of the lower outer periphery gear 111, the intermediate outer periphery gear 112, and the upper outer periphery gear 113 are arranged on the same perpendicular straight line. In contrast, in a third embodiment of the present invention, although the basic configuration is similar to that of the first embodiment, as illustrated in FIG. 6B, the rotation center Z of the upper outer periphery gear 113 is not on the perpendicular straight line through which the rotation centers X and Y of the two gears of the lower outer periphery gear 111 and the intermediate outer periphery gear 112 pass, and the straight line connecting Z and Y to each other is arranged so as to cross the straight line through which X and Y pass, at a predetermined angle A.

The predetermined angle A is 90° in FIG. 6B, but this is merely an example. As long as physical establishment is secured, the predetermined angle A may be larger or smaller than 90°, and is not particularly limited.

According to the third embodiment having such a configuration, the degree of freedom of layout of the upper drive motor and the lower drive motor, and therefore, the plate-like material feeding device may be improved. Thus, similarly to the first embodiment, it is possible to provide the plate-like material feeding device which is reduced in the installation space to maintain the degree of freedom of the installation layout and the like high and has a high conveyance capacity while having a configuration which is relatively simple and compact and leads to low cost. In addition, this configuration may further contribute to provision of a device which is capable of meeting a wide range of requirements of a user and is thus user-friendly.

In each of the above-mentioned embodiments, the case has been described in which the plate-like material wound in a roll shape is pulled out from the roll and the plate-like material is fed to the press machine as a material. However, the present invention is not limited to this, and may also be applied to conveyance of an intermediate product (a plate-like material after being punched out by a press) between press machines. Further, the present invention may be applied to any device that conveys a plate-like material regardless of whether or not the plate-like material is wound in a roll shape.

Further, the first and second embodiments have been described based on the example in which the rotation centers X, Y, and Z of the three gears of the lower outer periphery gear 111, the intermediate outer periphery gear 112, and the upper outer periphery gear 113 are arranged on the same perpendicular straight line, but the present invention is not limited to this. It is only required that the rotation centers X, Y, and Z of the three gears are arranged on the same straight line, and the present invention may be applied also to a case in which the straight line is not vertical.

As described above, according to at least one embodiment of the present invention, it is possible to provide the plate-like material feeding device which is reduced in the installation space to improve the degree of freedom of the installation layout and the maintainability and has a high conveyance capacity while having a configuration which is relatively simple and compact and leads to low cost.

The embodiments described above are each merely an example for describing the present invention, and various modifications may be made without departing from the gist of the present invention.

What is claimed is:

1. A sheet-shaped material feeding device configured to sandwich a sheet-shaped material between a lower roll rotatably supported on a device main body and an upper roll which is rotatable and arranged in parallel to the lower roll, so as to convey the sheet-shaped material, the sheet-shaped material feeding device comprising:

a lower gear integrally provided on a rotation shaft of the lower roll;

an intermediate gear which is meshed with the lower gear, and is integrally provided on a rotation shaft of the upper roll;

an upper gear meshed with the intermediate gear;

a lower-roll drive motor which is coupled to the rotation shaft of the lower roll so as to drive the rotation shaft of the lower roll to rotate; and an upper-roll drive motor configured to drive the upper gear to rotate.

2. The sheet-shaped material feeding device according to claim 1, wherein the lower-roll drive motor and the upper-roll drive motor are arranged on the same side with respect to the lower roll and the upper roll.

3. The sheet-shaped material feeding device according to claim 1, wherein the lower-roll drive motor and the upper-roll drive motor are located on a side opposite to a side on which the lower roll and the upper roll are arranged in relation to the intermediate gear.

4. The sheet-shaped material feeding device according to claim 1, wherein the upper roll and the intermediate gear are coupled to each other through intermediation of an Oldham's coupling.

5. The sheet-shaped material feeding device according to claim 1, wherein a rotation center of the lower gear, a rotation center of the intermediate gear, and a rotation center of the upper gear are arranged on the same straight line.

6. The sheet-shaped material feeding device according to claim 1, wherein a straight line connecting a rotation center of the lower gear and a rotation center of the intermediate gear to each other and a straight line connecting the rotation center of the intermediate gear and a rotation center of the upper gear to each other cross each other at a predetermined angle.

7. The sheet-shaped material feeding device according to claim 1, wherein the lower gear, the intermediate gear, and the upper gear have the same module and the same number of teeth.

8. The sheet-shaped material feeding device according to claim 1, wherein the lower gear and the intermediate gear have the same module and the same number of teeth, and the upper gear has the same module as the module of the lower gear and the intermediate gear and has the number of teeth larger than the number of teeth of the lower gear and the intermediate gear.

9. A sheet-shaped material feeding device configured to sandwich a sheet-shaped material between a lower roll rotatably supported on a device main body and an upper roll which is rotatable and arranged in parallel to the lower roll, so as to convey the sheet-shaped material, the sheet-shaped material feeding device comprising:

a lower gear integrally provided on a rotation shaft of the lower roll;

an intermediate gear meshed with the lower gear and integrally provided on a rotation shaft of the upper roll;

an idle gear meshed with the intermediate gear;

an upper gear meshed with the idle gear such that the idle gear is interposed between the intermediate gear and the upper gear;

a lower-roll drive motor which is coupled to the rotation shaft of the lower roll so as to drive the rotation shaft of the lower roll to rotate; and an upper-roll drive motor configured to drive the upper gear to rotate.

* * * * *